United States Patent [19]

Rice

[11] 3,957,266

[45] May 18, 1976

[54] EXERCISING POST AND PLATFORM

[76] Inventor: Max Rice, 120 Mac Dougal St., New York, N.Y. 10012

[22] Filed: Apr. 18, 1975

[21] Appl. No.: 569,460

[52] U.S. Cl. ..... 272/125; 273/DIG. 4; 272/144

[51] Int. Cl.[2] ..... A63B 21/00

[58] Field of Search ..... 272/79 R, 58, 57 R, 272/57 A, DIG. 4, 68, 67; 43/18 R; 273/DIG. 4

[56] References Cited

UNITED STATES PATENTS

| | | | |
|---|---|---|---|
| 303,474 | 8/1884 | Webb | 43/18 R X |
| 1,535,391 | 4/1925 | Anderson | 272/79 R |
| 3,196,558 | 7/1965 | Webb | 273/108 UX |

FOREIGN PATENTS OR APPLICATIONS

| | | | |
|---|---|---|---|
| 617,163 | 11/1926 | France | 272/79 R |

*Primary Examiner*—Richard C. Pinkham
*Assistant Examiner*—William R. Browne
*Attorney, Agent, or Firm*—Richard L. Miller

[57] ABSTRACT

An apparatus upon which a person can perform physical exercises so as to tone his muscles and promote muscular development; the device consisting of an angularly adjustable platform upon which the person stands, and a lower end of a tall pipe assembly being pivotable about a universal joint mounted upon the platform, the pipe assembly consisting of interconnected pipe sections all having a Teflon or other slippery material outer surface so to resist the person getting a firm grasp thereof during various exercises.

1 Claim, 5 Drawing Figures

34
36
31
18
30
29
12
10
33
33
20
21
11
14
13
19
35
35
35
32
28
27
28
16
17
15
20
19
17
15
16
17
15
16
27
26
25
23
24
21
19
20
22

EXERCISING POST AND PLATFORM

This invention relates generally to exercising apparatus.

A principal object of the present invention is to provide a novel type of exerciser in which there is a long post made of pipe and which has its outer, smooth surface made of Teflon or other slippery material so that the surface is slippery and a person thus cannot firmly hold the same, whereby attempt to do so will strengthen the muscles of the body that are involved in such exercise.

Another object is to provide an exercising post secured pivotally at its lower end on a platform whereupon the person can also stand so to hold the apparatus stable while exerting forces either upwardly or downwardly along the post.

Still another object is to provide an exercising post and platform wherein the tall post is made of interconnected, short pipe sections that can be pulled apart so that the device can be stored away within a small space when not in use.

Other objects are to provide an exercising post and platform which is simple in design, inexpensive to manufacture, rugged in construction, easy to use and efficient in operation.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

Figures 1, 2, 3, 4, 5:
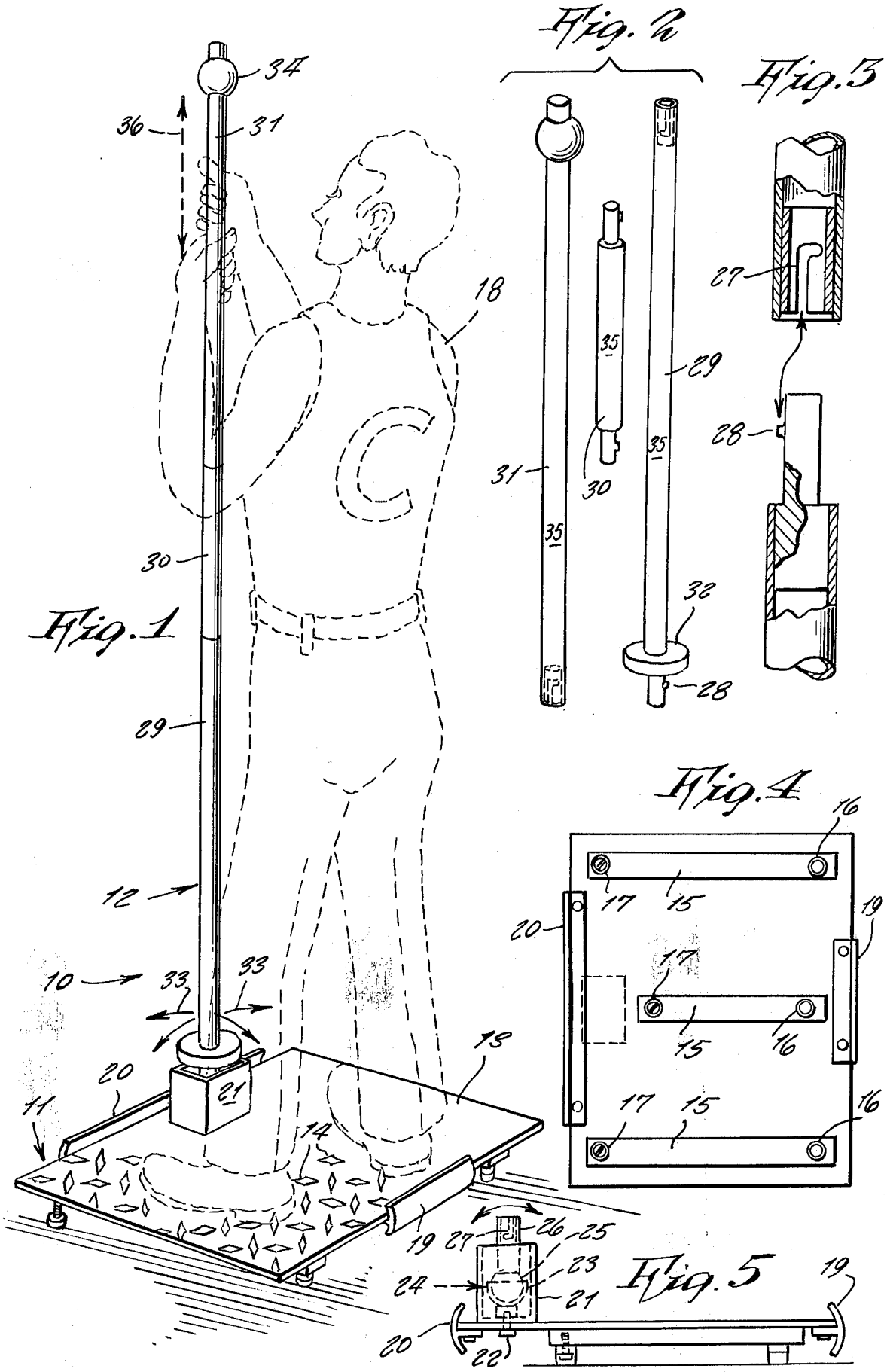
FIG. 1 is a perspective view of the invention shown in operative use.
FIG. 2 is a side view of the post pipe sections shown dis-assembled.
FIG. 3 is a side view partly in cross section showing a typical interconnecting structure of the pipe sections.
FIG. 4 is a bottom view of the platform.
FIG. 5 is a side view of the platform shown in a level position.

Referring now to the drawing in detail, the reference numeral 10 represents an exercising post and platform assembly according to the present invention wherein there is a platform 11 upon which there is supported an upstanding post 12.

The platform consists of rectangular, flat metal plate 13 having raised pattern design 14 on its upper side so to give frictional hold for a person's feet standing thereupon and thus prevent slipping. Three straight bars secured against the underside of the plate serve to form low legs 15. One end of each leg 15 has a fixed foot 16 and the other end has a vertically adjustable foot 17 so that the plate can be inclined at any slight angle, as shown in FI. 1, so to be comfortable to a person 18 standing thereupon. A short backedge rail 19 and a longer frontedge rail 20 are secured to the plate so a person can abut his feet thereagainst during use of the device.

A rectangular box 21 is secured upon the plate by means of a plurality of screws 22, the screws also securing a stationary socket 23 of a universal ball and socket joint 24 contained in the box. A ball 25 rotatably held in the socket is integral with a stub shaft 26 protruding out of an upper end of the box. The post 12 is detachably securable to the stub shaft by means of a bayonet slot 27 of the stub shaft receiving a projection 28 on one end of the post.

The post is made of pipe sections 29, 30 and 31 which are interconnected by means of bayonet slots 27 and projections 28 as described.

The lowermost secton 29 additionally includes a flange 32 near its lower end for enclosing the top of the box by being spaced slightly above the box upper edge so to allow the post freedom to pivot as shown by arrows 33, in FIG. 2. The uppermost pipe secton 31 has a spherical ball 34 near its upper end. The outer side of the sections are smooth and coated with Teflon or other material 35 which has the characteristic property of being slippery so nothing can hold securely thereto.

In operative use, accordingly, as shown in FIG. 1, the person can grasp the pole firmly in his hands and then try to exert pressure either upwardly or downwardly as shown by arrows 36 so the hands thus will slide while firmly grasping the device. This will strengthen all muscles involved. Various different exercises may be performed with the apparatus.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. In an exercising post and platform assembly, the combination of a platform upon which a person can stand, and an upwardly extending post being supported upon said platform, said post being comprised of interconnected pipe sections each having a smooth outer surface consisting of slippery Teflon material so that a firm non-slip grasp thereof by hands of a user will not be possible; said platform comprising a flat metal plate having a raised pattern upon its upper side, a plurality of legs underneath said plate, fixed feet at one end of said legs and vertically adjustable feet at the other end thereof, and railings along opposite edges of said plate, a rectangular box mounted upon said plate, a square opening at an upper end of said box, an upper edge of said box being parallel to said plate, a ball and socket joint contained within said box having a socket secured to said platform, and a stub shaft integral with the ball of said joint, said shaft protruding upwardly out of said box., said post being detachably attached to said stub shaft, and a flange around a lower end of said post covering said box opening, said post pivotable about said joint abutting said box upper edge at extreme tilt of said post, said post having increasing greater tilt when tilted closer to a square corner of said box upper edge, said pipe sections being detachable attached together by bayonet slots and projections received therein.

* * * * *